US010734758B2

(12) United States Patent
Sifuentes et al.

(10) Patent No.: US 10,734,758 B2
(45) Date of Patent: Aug. 4, 2020

(54) CONNECTOR-ASSEMBLY WITH STRAIN-RELIEF-DEVICE

(71) Applicant: Delphi Technologies, LLC, Troy, MI (US)

(72) Inventors: Jose F. Sifuentes, Saltillo (MX); Marcelino Hernandez, Saltillo (MX); Jesus R. Morales, Cd. Juarez (MX)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 41 days.

(21) Appl. No.: 16/059,092

(22) Filed: Aug. 9, 2018

(65) Prior Publication Data

US 2020/0052436 A1 Feb. 13, 2020

(51) Int. Cl.
*H01R 13/58* (2006.01)
*H01R 13/514* (2006.01)

(52) U.S. Cl.
CPC ..... *H01R 13/5812* (2013.01); *H01R 13/514* (2013.01)

(58) Field of Classification Search
CPC ..... H01R 13/58; H01R 13/5812
USPC ..... 439/465, 467
See application file for complete search history.

(56) References Cited

U.S. PATENT DOCUMENTS 4,963,104 A * 10/1990 Dickie ..... H01R 9/0524 439/460
5,860,832 A * 1/1999 Wayt ..... H01R 12/775 439/465
6,129,576 A * 10/2000 Sakaguchi ..... H01R 13/5208 439/465
6,296,399 B1 * 10/2001 Halbach ..... G02B 6/3831 385/139
7,241,183 B2 * 7/2007 Wasalaski ..... H01R 13/447 439/686
7,476,121 B2 * 1/2009 Tsuji ..... H01R 13/4223 439/465
7,670,169 B1 * 3/2010 Pai ..... H01R 13/655 439/465

(Continued)

*Primary Examiner* — Tulsidas C Patel
*Assistant Examiner* — Marcus E Harcum
(74) *Attorney, Agent, or Firm* — Michael A. Collins; Billion & Armitage

(57) ABSTRACT

A connector assembly includes, a connector-body, a dress-cover, a strain-relief-device, and a housing. The a connector-body retains electrical-terminals connected to cables enclosed in conduit. The dress-cover is attached to the connector-body and routes the cables. The dress-cover has sides and a base that receive the connector-body. The strain-relief-device is attached to the dress-cover. The strain-relief-device has a close-out panel having opposed side-edges, a top-edge and a bottom-edge. The housing has walls and a bottom configured to receive the connector-body, the dress-cover, and the strain-relief-device. The walls define a slot, and the connector-body, dress-cover, and a portion of the strain-relief-device are disposed within the slot. The walls have opposing-channels on a first-side and a second-side of the slot and terminate at the stops. The opposing-channels slideably engage the opposed side-edges. The bottom-edge engages the stops when the connector-body, the dress-cover and the portion of the strain-relief-device are disposed within the slot.

12 Claims, 4 Drawing Sheets

(56) References Cited

U.S. PATENT DOCUMENTS

| | | | | |
|---|---|---|---|---|
| 8,702,444 | B2 * | 4/2014 | Maranto | H01R 24/64 439/467 |
| 9,627,785 | B1 * | 4/2017 | Melchor Saucedo | H01R 13/506 |
| 10,290,970 | B1 * | 5/2019 | Weber, Jr. | H01R 13/5205 |
| 2002/0045376 | A1 * | 4/2002 | Abe | H01R 12/675 439/374 |
| 2016/0020551 | A1 * | 1/2016 | Schnurpfeil | H01R 13/516 439/275 |
| 2019/0288444 | A1 * | 9/2019 | Sugimoto | H01R 13/5812 |

* cited by examiner

CONNECTOR-ASSEMBLY WITH STRAIN-RELIEF-DEVICE

TECHNICAL FIELD OF INVENTION

This disclosure generally relates to a connector-assembly, and more particularly relates to a connector-assembly with a strain-relief-device.

BRIEF DESCRIPTION OF DRAWINGS

The present invention will now be described, by way of example with reference to the accompanying drawings, in which.

DETAILED DESCRIPTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
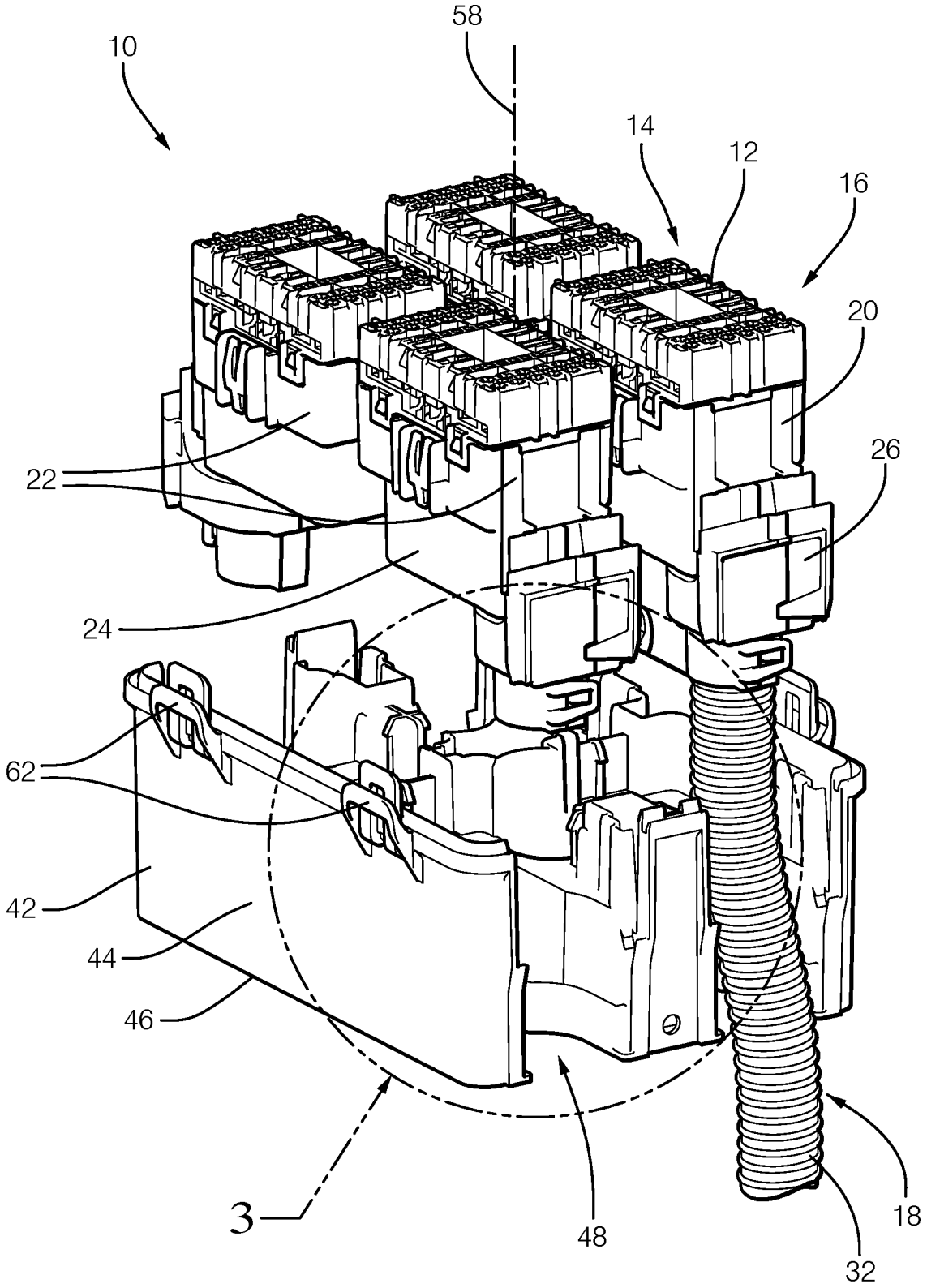
FIG. 1 is a partial exploded perspective view of a connector-assembly in accordance with one embodiment.

FIG. 1 is a partial exploded view illustrating a connector-assembly 10, hereafter referred to as the assembly 10. As will be described in more detail below, the assembly 10 is an improvement over other connector assemblies, because the assembly 10 enables an ergonomic installation process into a vehicle. The assembly 10 includes a connector-body 12 having a terminal-end 14 and a wire-end 16. The connector-body 12 is configured to retain a plurality of electrical-terminals (not shown). The connector-body 12 is formed of a polymeric dielectric material. The polymeric dielectric material may be any polymeric dielectric material capable of electrically isolating portions of the electrical-terminals, and is preferably a polyamide (NYLON) material. The electrical-terminals are configured to mate with corresponding-electrical-terminals of a mating-connector (not shown). The electrical-terminals are formed of an electrically conductive material, such as a copper-based alloy that may also include a coating of another conductive material (e.g. a tin-based or silver-based coating). The electrical-terminals are connected to a plurality of cables (not shown) extending beyond the wire-end 16 and enclosed in a conduit 18.

The assembly 10 also includes a dress-cover 20 removably attached to the connector-body 12. The dress-cover 20 is configured to direct a routing of the plurality of cables within the conduit 18. The dress-cover 20 is preferably formed of the polyamide (NYLON) material. The dress-cover 20 has sides 22 and a base 24 defining a first-aperture (not specifically shown) configured to receive the connector-body 12. The base 24 defines a second-aperture (not specifically shown) through which the plurality of cables extend.

The assembly 10 also includes a strain-relief-device 26 removably attached to one side of the dress-cover 20. In the example illustrated in FIG. 1, the strain-relief-device 26 has a first-half 28 and a second-half 30 removably attached to the first-half 28. In another embodiment, the first-half 28 of the strain-relief-device 26 is formed integral to the dress-cover 20 with the second-half 30 removably attached to the first-half 28. The strain-relief-device 26 is preferably formed of the polyamide (NYLON) material. The strain-relief-device 26 is in compressive contact with an outer-surface 32 of the conduit 18 and inhibits environmental contamination (i.e. water, dust, engine fluids, etc.) from entering the strain-relief-device 26 along the outer-surface 32 of the conduit 18.

Figure 2:
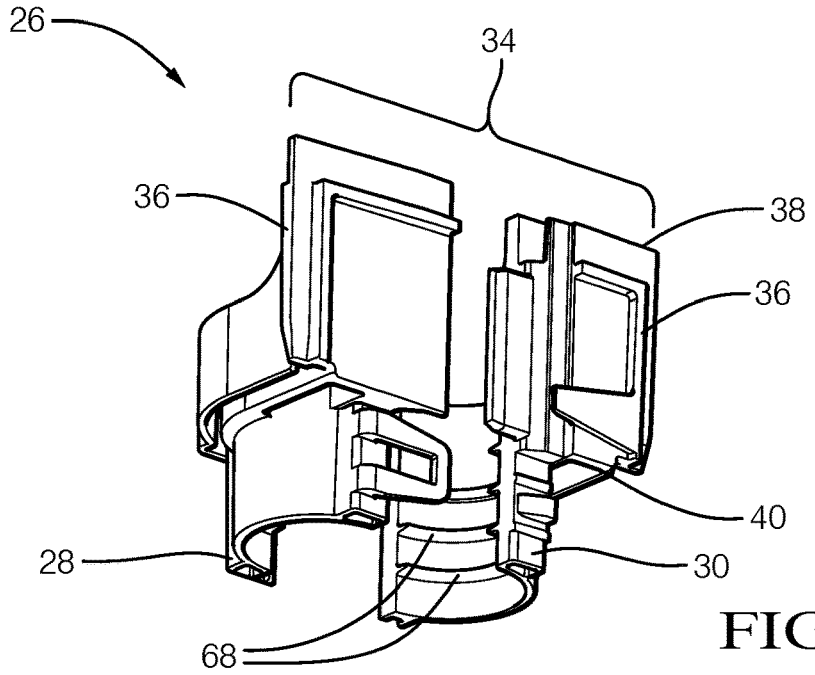
FIG. 2 is a perspective view of a strain-relief-device isolated from the connector-assembly of FIG. 1. in accordance with one embodiment.

FIG. 2 is an exploded perspective view of the strain-relief-device 26 isolated from the assembly 10, illustrating the first-half 28 and the second-half 30 separated from one another. The strain-relief-device 26 has a close-out panel 34 having a generally rectilinear-shape. The close-out panel 34 has opposed side-edges 36, a top-edge 38, and a bottom-edge 40 opposite the top-edge 38. As will be explained in more detail below, the close-out panel 34 provides a barrier to the environmental contamination entering the assembly 10.

Referring back to FIG. 1, the assembly 10 also includes a housing 42 configured to attach to a vehicle-body (not shown). The housing 42 is preferably formed of the polyamide (NYLON) material. The housing 42 has walls 44 and a bottom 46 defining a cavity 48 configured to receive the connector-body 12, the dress-cover 20, and the strain-relief-device 26.

Figure 3:
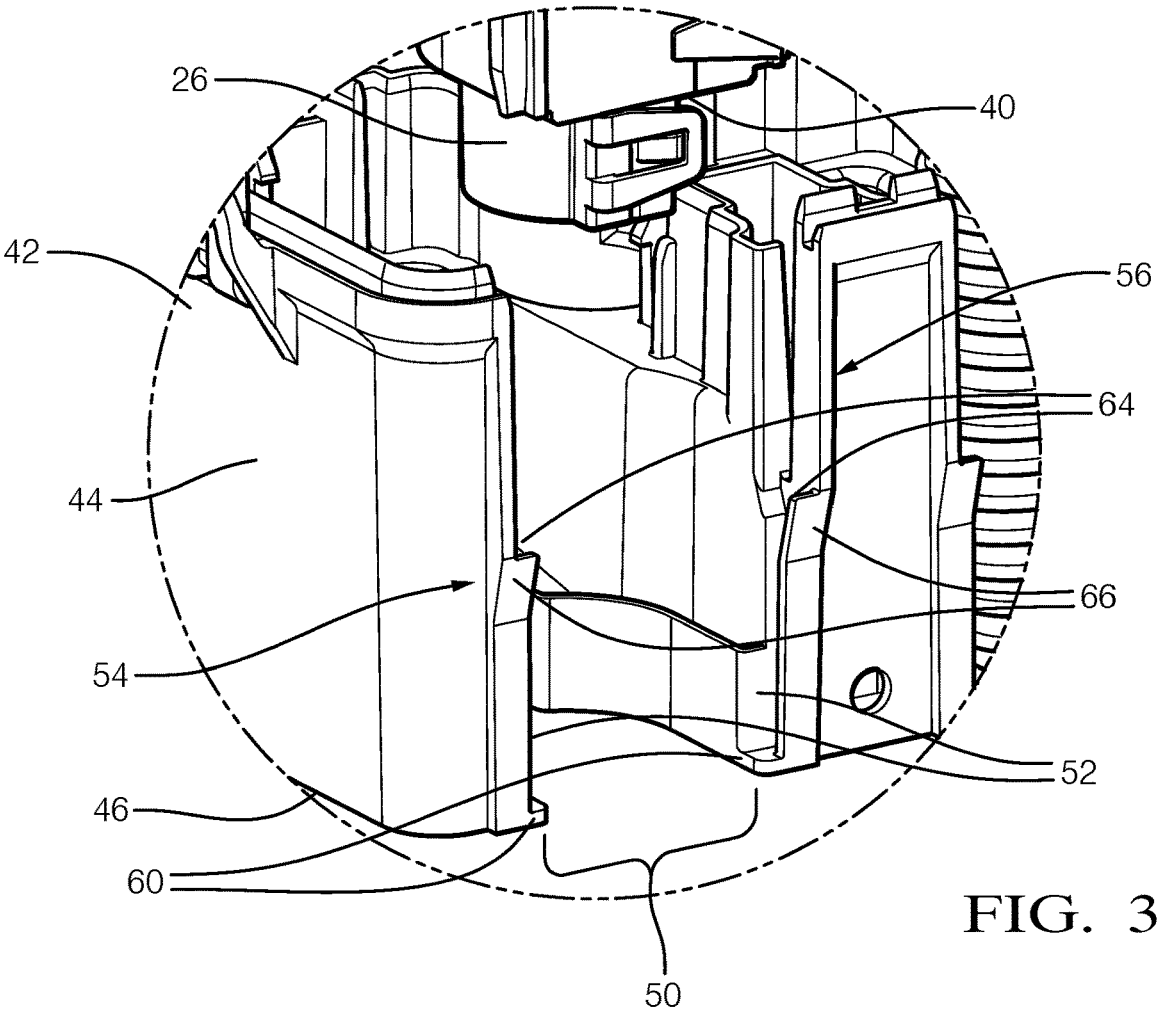
FIG. 3 is a magnified view of a segment of a housing 42 from the connector-assembly of FIG. 1 in accordance with one embodiment.

FIG. 3 is a magnified view of a segment of the housing 42 from FIG. 1. The walls 44 define a slot 50 extending into the cavity 48 and into a portion of the bottom 46. When fully assembled, the connector-body 12, the dress-cover 20, and a portion of the strain-relief-device 26 (e.g., excluding the close-out panel 34) are disposed within the slot 50. The walls 44 have opposing-channels 52 on a first-side 54 and a second-side 56 of the slot 50. The opposing-channels 52 extend along the walls 44 parallel to a mating-axis 58 (see FIG. 1) of the assembly 10 and terminate at a stops 60 proximate to the bottom 46 of the housing 42. The opposing-channels 52 are configured to slideably engage the opposed side-edges 36 of the strain-relief-device 26 and guide the connector-body 12, the dress-cover 20, and the strain-relief-device 26 into the housing 42. The bottom-edge 40 of the close-out panel 34 engages the stops 60 when the connector-body 12, the dress-cover 20, and the portion of the strain-relief-device 26 are disposed within the slot 50, thereby inhibiting contamination from entering the slot 50. In the example illustrated in FIG. 1, the dress-cover 20 routes the plurality of cables enclosed in the conduit 18 through the bottom 46 of the housing 42.

Referring again to FIG. 1, the walls 44 of the housing 42 include flexible-locks 62 configured to releasably lock the dress-cover 20 when the bottom-edge 40 of the strain-relief-device 26 engages the stops 60 of the opposing-channels 52.

Referring back to FIG. 3, the opposing-channels 52 define entrances 64 that include chamfers 66 configured to enable an angled-insertion of the opposed side-edges 36 into the opposing-channels 52. The angled-insertion is beneficial because the angled-insertion enables the ergonomic installation for an operator when a work-space is limited, as may be experienced when installing the assembly 10 in a vehicle-assembly-plant.

Referring back to FIG. 2, the strain-relief-device 26 includes ridges 68 configured to engage grooves (see FIG. 1—not specifically shown) defined by the outer-surface 32 of the conduit 18.

Figure 4:
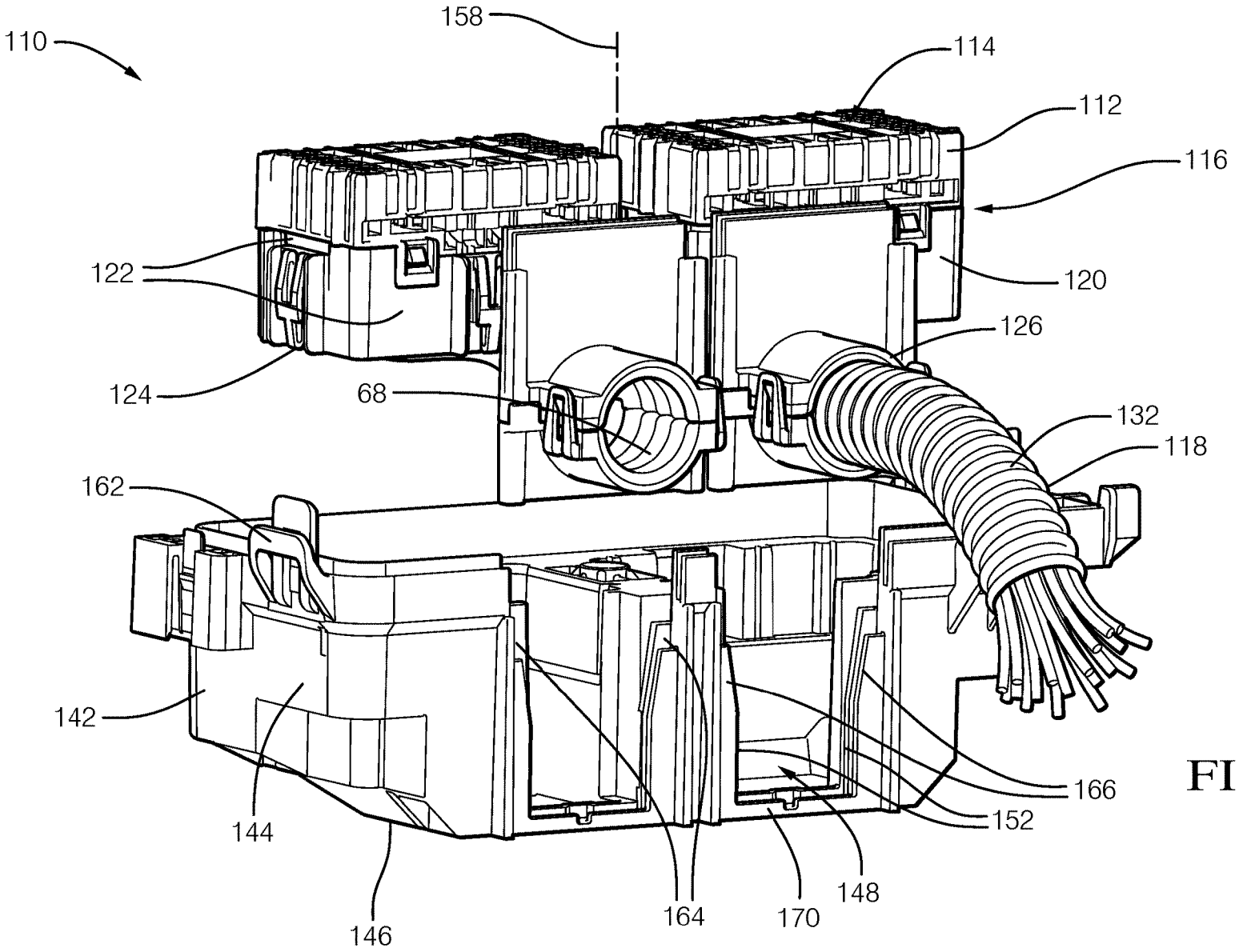
FIG. 4 is a partial exploded perspective view of a connector-assembly in accordance with another embodiment.

FIG. 4 illustrates another embodiment of a connector-assembly 110, hereafter referred to as the assembly 110. The assembly 110 includes a connector-body 112 having a terminal-end 114 and a wire-end 116. The connector-body 112 is configured to retain a plurality of electrical-terminals (not shown). The connector-body 112 is formed of a polymeric dielectric material. The polymeric dielectric material may be any polymeric dielectric material capable of electrically isolating portions of the electrical-terminals, and is preferably a polyamide (NYLON) material. The electrical-terminals are configured to mate with corresponding-electrical-terminals of a mating-connector (not shown). The electrical-terminals are formed of an electrically conductive material, such as a copper-based alloy that may also include a coating of another conductive material (e.g. a tin-based or silver-based coating). The electrical-terminals are connected to a plurality of cables (not shown) extending beyond the wire-end 116 and enclosed in a conduit 118.

The assembly 110 also includes a dress-cover 120 removably attached to the connector-body 112. The dress-cover 120 is configured to direct a routing of the plurality of cables. The dress-cover 120 is preferably formed of the polyamide (NYLON) material. The dress-cover 120 has sides 122 and a base 124 defining a first-aperture (not specifically shown) configured to receive the connector-body 112. The base 124 defines a second-aperture (not specifically shown) through which the plurality of cables extend.

The assembly 110 also includes a strain-relief-device 126 attached to one side of the dress-cover 120. In the example illustrated in FIG. 4, the strain-relief-device 126 has a first-half 128 and a second-half 130 removably attached to the first-half 128 and the first-half 128 of the strain-relief-device 126 is formed integral to the dress-cover 120. In another embodiment, the strain-relief-device 126 is removably attached to the dress-cover 120 with the second-half 130 removably attached to the first-half 128. The strain-relief-device 126 is preferably formed of the polyamide (NYLON) material. The strain-relief-device 126 is in compressive contact with an outer-surface 132 of the conduit 118 and inhibits environmental contamination (i.e. water, dust, engine fluids, etc.) from entering the strain-relief-device 126 along the outer-surface 132 of the conduit 118.

Figure 5:
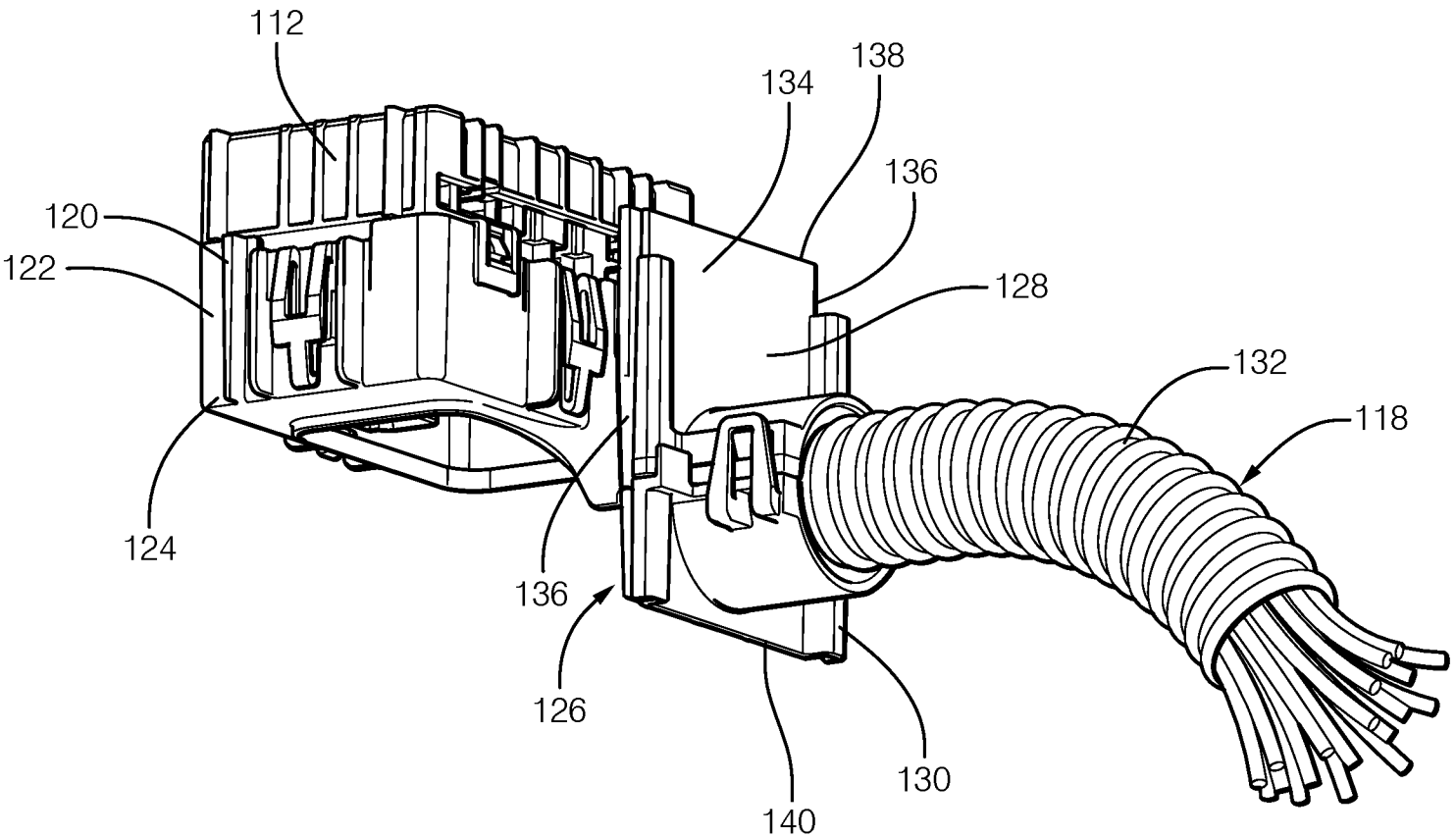
FIG. 5 is a perspective view of a connector-body, a dress-cover, and a strain-relief-device, isolated from the assembly of FIG. 4. in accordance with another embodiment.

FIG. 5 is a perspective view of the connector-body 112, the dress-cover 120, and the strain-relief-device 126 isolated from the assembly 110 of FIG. 4. The strain-relief-device 126 has a close-out panel 134 having a generally rectilinear-shape. The close-out panel 134 has opposed side-edges 136, a top-edge 138, and a bottom-edge 140 opposite the top-edge 138. As will be explained in more detail below, the close-out panel 134 provides a barrier to the environmental contamination entering the assembly 110.

Referring back to FIG. 4, the assembly 110 also includes a housing 142 configured to attach to a vehicle-body (not shown). The housing 142 is preferably formed of the polyamide (NYLON) material. The housing 142 has walls 144 and a bottom 146 defining a cavity 148 configured to receive the connector-body 112, the dress-cover 120, and the strain-relief-device 126. The walls 144 define a slot 150 extending into the cavity 148 into which the connector-body 112, the dress-cover 120, and a portion of the strain-relief-device 126 are disposed. The walls 144 have opposing-channels 152 on a first-side 154 and a second-side 156 of the slot 150 extending along the walls 144 parallel to a mating-axis 158 of the assembly 110, and terminating at a bottom-channel 170 proximate to the bottom 146 of the housing 142. The opposing-channels 152 are configured to slideably engage the opposed side-edges 136 of the strain-relief-device 126 and guide the connector-body 112, the dress-cover 120, and the strain-relief-device 126 into the housing 142. The bottom-edge 140 of the strain-relief-device 126 engages the bottom-channel 170 when the connector-body 112, the dress-cover 120, and the portion of the strain-relief-device 126 are disposed within the slot 150, thereby inhibiting contamination from entering the slot 150. In the example illustrated in FIG. 4, the dress-cover 120 routes the plurality of cables enclosed in the conduit 118 through the walls 144 of the housing 142.

Referring again to FIG. 4, the walls 144 of the housing 142 include flexible-locks 162 configured to releasably lock the dress-cover 120 when the bottom-edge 140 of the strain-relief-device 126 engages bottom-channel 170 of the housing 142. The opposing-channels 152 define entrances 164 that include chamfers 166 configured to enable an angled-insertion of the opposed side-edges 136 into the opposing-channels 152. The angled-insertion is beneficial because the angled-insertion enables the ergonomic installation for an operator when a work-space is limited, as may be experienced when installing the assembly 110 in a vehicle-assembly-plant.

Referring back to FIG. 5, the strain-relief-device 126 includes ridges 168 configured to engage grooves (not specifically shown) defined by the outer-surface 132 of the conduit 118.

Accordingly, a connector-assembly 10, 110 is provided. The connector-assembly 10, 110 is an improvement over prior art connector assemblies because the connector-assembly 10, 110 enables an ergonomic installation process by eliminating the requirement for an installer to force the cables into the correct routing for installation into a vehicle.

While this invention has been described in terms of the preferred embodiments thereof, it is not intended to be so limited, but rather only to the extent set forth in the claims that follow. "One or more" includes a function being performed by one element, a function being performed by more than one element, e.g., in a distributed fashion, several functions being performed by one element, several functions being performed by several elements, or any combination of the above. It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact. The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context. Directional terms such as top, bottom, upper, lower, left, right, front, rear, etc. do not denote any particular orientation, but rather these directional terms are used to distinguish one element from another and establish a relationship between the various elements.

We claim:

1. A connector assembly, comprising:

a connector-body having a terminal-end and a wire-end, the connector-body configured to retain a plurality of electrical-terminals, the plurality of electrical-terminals connected to a plurality of cables, the plurality of cables extending beyond the wire-end and enclosed in a conduit;

a dress-cover removably attached to the connector-body, the dress-cover configured to direct a routing of the plurality of cables, the dress-cover having sides and a base defining a first-aperture configured to receive the connector-body, the base defining a second-aperture through which the plurality of cables extend;

a strain-relief-device removably attached one side of the dress-cover, the strain-relief-device having a first-half and a second-half removably attached to the first-half, the strain-relief-device in compressive contact with an outer-surface of the conduit, the strain-relief-device having a close-out panel having a generally rectilinear-shape, the close-out panel having opposed side-edges, a top-edge and a bottom-edge opposite the top-edge; and a housing configured to attach to a vehicle-body, the housing having walls and a bottom defining a cavity, the cavity configured to receive the connector-body, the dress-cover, and the strain-relief-device, the walls defining a slot extending into the cavity, the connector-body, the dress-cover and a portion of the strain-relief-device disposed within the slot, the walls having opposing-channels on a first-side and a second-side of the slot, the opposing-channels extending along the walls parallel to a mating-axis of the connector assembly and terminating at a bottom-channel proximate to the bottom of the housing, the opposing-channels configured to slideably engage the opposed side-edges of the strain-relief-device, wherein the bottom-edge of the strain-relief-device engages the bottom-channel when the connector-body, the dress-cover and the portion of the strain-relief-device are disposed within the slot, thereby inhibiting contamination from entering the slot.

2. The connector assembly in accordance with claim 1, wherein the walls of the housing include flexible-locks configured to releasably lock the dress-cover when the bottom-edge of the strain-relief-device engages the bottom-channel.

3. The connector assembly in accordance with claim 1, wherein the opposing-channels define entrances that include chamfers, the chamfers configured to enable an angled-insertion of the opposed side-edges into the opposing-channels.

4. The connector assembly in accordance with claim 1, wherein the strain-relief-device includes ridges configured to engage grooves defined by the outer-surface of the conduit.

5. The connector assembly in accordance with claim 1, wherein the first-half of the strain-relief-device is formed integral to the dress-cover.

6. The connector assembly in accordance with claim 1, wherein the dress-cover routes the plurality of cables through the sides of the housing.

7. A connector assembly, comprising:

a connector-body having a terminal-end and a wire-end;

a plurality of electrical-terminals connected to a plurality of cables, the plurality of cables enclosed in a conduit;

a dress-cover removably attached to the connector-body defining a first-aperture configured to receive the connector-body and a second-aperture through which the plurality of cables extend;

a strain-relief-device removably attached to the dress-cover, the strain-relief-device having a close-out panel; and a housing defining a cavity configured to receive the connector-body, the dress-cover, and the strain-relief-device, the housing defining a slot extending into the cavity, the connector-body, the dress-cover and a portion of the strain-relief-device disposed within the slot, the housing having opposing-channels on each side of the slot which extend parallel to a mating-axis of the connector assembly and terminate at a bottom-channel proximate to the bottom of the housing, the opposing-channels configured to slideably engage the strain-relief-device, wherein the strain-relief-device engages the bottom-channel when the connector-body, the dress-cover and the portion of the strain-relief-device are disposed within the slot.

8. The connector assembly in accordance with claim 7, wherein the housing includes flexible-locks configured to releasably lock the dress-cover when the strain-relief-device engages the bottom-channel.

9. The connector assembly in accordance with claim 7, wherein the opposing-channels define entrances that include chamfers configured to enable an angled-insertion of the close-out panel into the opposing-channels.

10. The connector assembly in accordance with claim 7, wherein the strain-relief-device includes ridges configured to engage grooves defined by the conduit.

11. The connector assembly in accordance with claim 7, wherein the portion of the strain-relief-device is formed integral to the dress-cover.

12. The connector assembly in accordance with claim 7, wherein the dress-cover routes the plurality of cables through the housing.

* * * * *